US007877940B2

(12) United States Patent
Meeks et al.

(10) Patent No.: US 7,877,940 B2
(45) Date of Patent: Feb. 1, 2011

(54) ENTRYWAY FOR DISPOSITION IN A DOOR OPENING OF A BUILDING

(75) Inventors: James W. Meeks, Eaton, OH (US); David C. Bryant, Richmond, IN (US)

(73) Assignee: Quanex Corporation, Houston, TX (US)

( * ) Notice: Subject to any disclaimer, the term of this patent is extended or adjusted under 35 U.S.C. 154(b) by 114 days.

(21) Appl. No.: 12/179,332

(22) Filed: Jul. 24, 2008

(65) Prior Publication Data

US 2009/0025299 A1 Jan. 29, 2009

Related U.S. Application Data

(60) Provisional application No. 60/951,706, filed on Jul. 24, 2007.

(51) Int. Cl.
*E06B 1/70* (2006.01)
*E06B 1/04* (2006.01)

(52) U.S. Cl. ..... 52/212; 49/467; 49/471; 49/469; 52/58

(58) Field of Classification Search ..... 52/204.1, 52/211, 212, 58, 60, 61, 656.4; 49/467, 469, 49/471, 504

See application file for complete search history.

(56) References Cited

U.S. PATENT DOCUMENTS

| | | | | |
|---|---|---|---|---|
| 488,501 | A | 12/1892 | Hudson | |
| 2,603,841 | A | 12/1948 | Drake et al. | |
| 3,851,420 | A * | 12/1974 | Tibbetts | 49/471 |
| 3,900,967 | A * | 8/1975 | Bursk et al. | 49/468 |
| 4,555,882 | A | 12/1985 | Moffitt et al. | |
| 5,067,279 | A * | 11/1991 | Hagemeyer | 49/471 |
| 5,136,814 | A * | 8/1992 | Headrick | 49/468 |
| 5,179,804 | A | 1/1993 | Young | |
| 5,542,217 | A | 8/1996 | Larivee, Jr. | |
| 6,161,343 | A | 12/2000 | Young | |
| 6,219,971 | B1 * | 4/2001 | Headrick | 49/469 |
| 6,219,979 | B1 | 4/2001 | Lohr | |
| 6,385,925 | B1 | 5/2002 | Wark | |
| 6,401,401 | B1 * | 6/2002 | Williams | 52/58 |
| 6,401,402 | B1 | 6/2002 | Williams | |
| 6,725,610 | B2 | 4/2004 | Murphy et al. | |
| 6,763,639 | B2 * | 7/2004 | Bennett et al. | 52/212 |
| 6,789,358 | B2 * | 9/2004 | Procton et al. | 49/471 |
| 7,059,087 | B2 | 6/2006 | Allen | |
| 7,222,462 | B2 | 5/2007 | Ellingson | |

(Continued)

*Primary Examiner*—Brian E Glessner
*Assistant Examiner*—Benjamin Pevarski
(74) *Attorney, Agent, or Firm*—Howard & Howard Attorneys PLLC

(57) ABSTRACT

An entryway for disposition in a door opening of a building includes a threshold and a corner sealing member mounted in the door opening between the building and the threshold. The threshold has a bottom facing downwardly and a back extending upwardly from the bottom. The corner sealing member has a middle portion disposed partially below the bottom of the threshold, a first vertical portion extending upwardly from the middle portion adjacent the threshold, and a second vertical portion extending upwardly from the middle portion transversely from the first vertical portion. The back of the threshold defines a recess and the second vertical portion of the corner sealing member is disposed in the recess to allow for adequate sealing between the threshold and the corner sealing member and to allow for proper placement of the threshold in the door opening without interference from the corner sealing member.

25 Claims, 7 Drawing Sheets

U.S. PATENT DOCUMENTS

| | | | | |
|---|---|---|---|---|
| 7,263,808 | B2 * | 9/2007 | Massey et al. | 52/204.1 |
| 2003/0005644 | A1 | 1/2003 | Reithmeyer et al. | |
| 2003/0177710 | A1 | 9/2003 | Gatherum | |
| 2003/0177711 | A1 | 9/2003 | Gatherum | |
| 2003/0177712 | A1 | 9/2003 | Gatherum | |
| 2003/0177725 | A1 | 9/2003 | Gatherum | |
| 2003/0177727 | A1 | 9/2003 | Gatherum | |
| 2005/0055912 | A1 | 3/2005 | Teodorovich | |
| 2005/0166471 | A1 | 8/2005 | Allen | |
| 2005/0217189 | A1 | 10/2005 | Moffitt | |
| 2005/0268569 | A1 | 12/2005 | Teodorovich | |
| 2005/0279044 | A1 | 12/2005 | Mileti et al. | |
| 2006/0010788 | A1 | 1/2006 | Nettleton | |
| 2006/0101726 | A1 * | 5/2006 | Collins | 52/58 |
| 2006/0137263 | A1 | 6/2006 | Casey | |
| 2006/0150521 | A1 | 7/2006 | Henry et al. | |
| 2006/0260213 | A1 | 11/2006 | Williams | |
| 2007/0094957 | A1 | 5/2007 | Burton et al. | |
| 2008/0010904 | A1 * | 1/2008 | Meeks et al. | 49/484.1 |

* cited by examiner

FIG - 3A
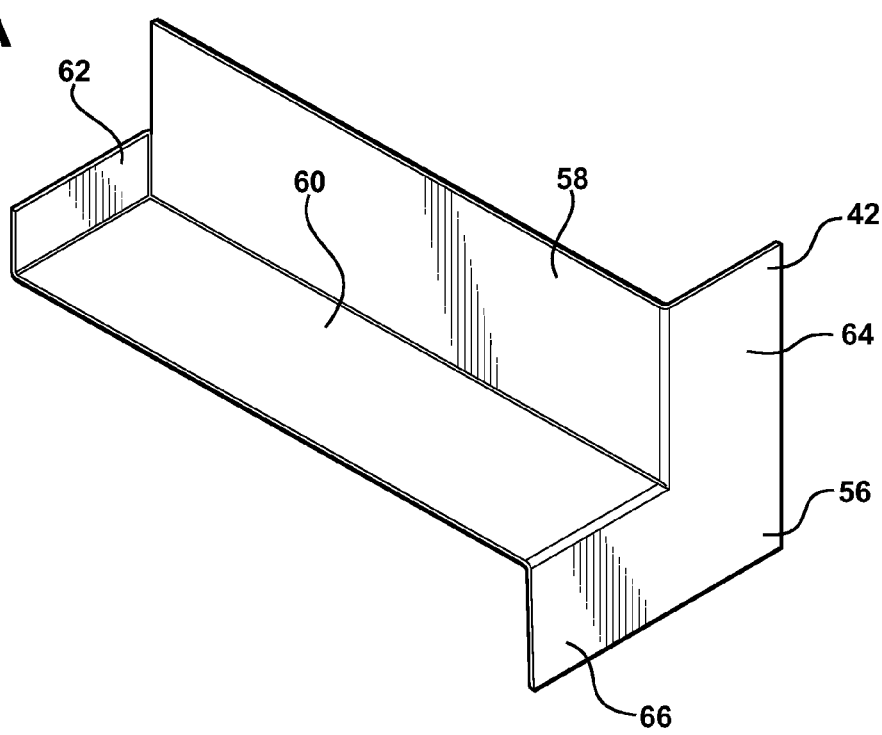
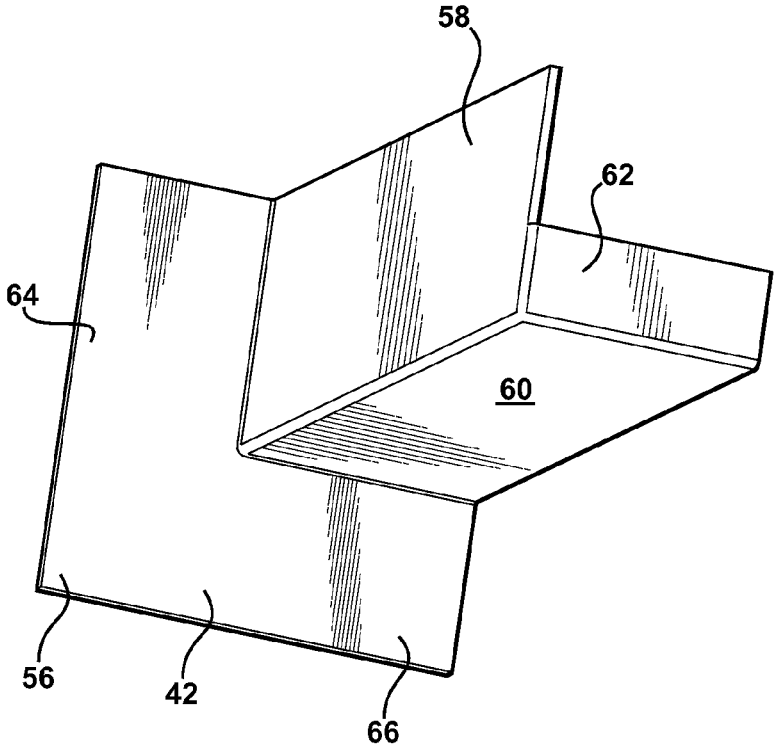
FIG - 3B

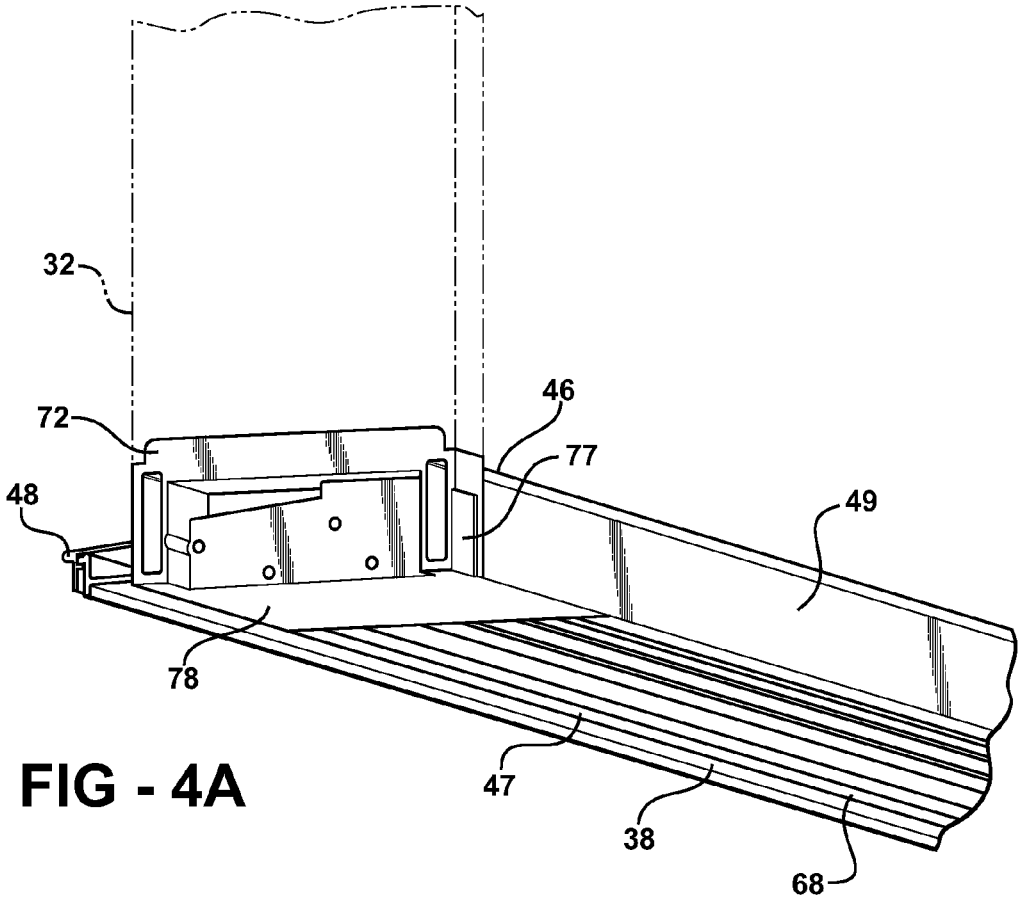
FIG - 4A
FIG - 4B
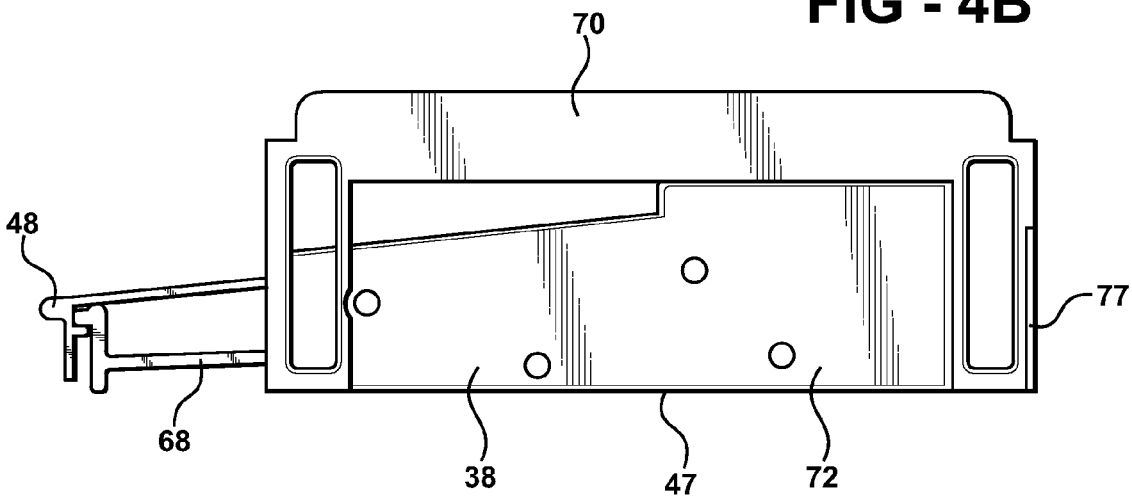

ENTRYWAY FOR DISPOSITION IN A DOOR OPENING OF A BUILDING

CROSS-REFERENCE TO RELATED APPLICATIONS

The subject patent application claims priority to and all the benefits of U.S. Provisional Patent Application Ser. No. 60/951,706 which was filed on Jul. 24, 2007, the entire specification of which is expressly incorporated herein by reference.

BACKGROUND OF THE INVENTION

1. Field of the Invention

The present invention generally relates to an entryway for disposition in a door opening of a building, and specifically, in a door opening of a building defined by a floor and first and second frame members extending upwardly from the floor.

2. Description of the Related Art

An entryway is disposed in a door opening of a building between an exterior and interior of the building. The door opening is defined by framing including first and second frame members spaced from each other and extending vertically. The entryway includes a frame and a door mounted to the frame. The frame includes a first jamb mounted to the first frame member of the framing and a second jamb spaced from and parallel with the first jamb and mounted to the second frame member of the framing. A threshold is mounted to the building and extends across the door opening from the first frame member to the second frame member. The first and second jambs are supported by and extend upwardly from the threshold.

The first and second frame members must be spaced a sufficient distance apart from each other such that the threshold can be installed between the first and second frame members. However, to ensure that the threshold fits between the first and second frame members, the door opening is designed to be slightly wider than the threshold such that a gap exists between the threshold and the first and/or second frame members. This gap also extends upwardly between the first frame member and the first jamb and between the second frame member and the second jamb.

Water, usually from rain, enters the gap between the first jamb and the first frame member and between the second jamb and the second frame member. The water flows downwardly by gravity toward a bottom of the frame and framing. When the water reaches the bottom of the frame and framing, some of the water disadvantageously runs into the interior of the building. In addition, the framing is typically formed of wood. Water and moisture from the rain settles at the bottom of the frame between the first and second vertical members and the framing, which results in water damage and rotting of the framing.

Accordingly, it would be advantageous to manufacture an entryway that diverts water from to the exterior of the building and prevents water and moisture from settling on the framing.

SUMMARY OF THE INVENTION AND ADVANTAGES

The present invention includes an entryway for disposition in a door opening of a building defined by a floor and first and second frame members extending upwardly from the floor. The entryway comprises a threshold. The threshold has a first end for disposition adjacent the first frame member and a second end spaced from the first end for disposition adjacent the second frame member. The threshold also has a bottom facing downwardly from the first end to the second end and a back extending upwardly from the bottom between the first end and the second end. The entryway includes a jamb extending upwardly relative to the threshold at the first end of the threshold and supported by the threshold for disposition adjacent the first frame member. The entryway includes a corner sealing member. The corner sealing member has a middle portion disposed partially below the bottom of the threshold for sealing to the floor, a first vertical portion extending upwardly from the middle portion adjacent the first end of the threshold for sealing to the first frame member, and a second vertical portion extending upwardly from the middle portion transversely from the first vertical portion. The back of the threshold defines a recess and the second vertical portion of the corner sealing member is disposed in the recess.

Accordingly, when subjected to water, the corner sealing member diverts water away from the frame member and the floor of the building and prevents water and moisture from settling along the frame member and the floor. In other words, during rain, water will flow downwardly between the jamb and the frame member of the building to the corner sealing member. This water is diverted by the corner sealing member to the exterior of the building. Because the threshold defines the recess and the second vertical portion is disposed in the recess, the threshold adequately seals to the corner sealing member to prevent water from migrating toward the floor or the frame member or toward the interior of the building. In addition, because the second vertical portion is disposed in the recess, the corner sealing member seals to the back of the threshold regardless of the transverse position of the threshold relative to the first and second frame members, i.e., regardless of whether the threshold is further from the first frame member or further from the second frame member. In addition, because the second vertical portion is disposed in the recess, the threshold can be properly positioned relative to the floor and the frame members without interference by the corner sealing member.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 3A is a front perspective view of the second corner sealing member;

FIG. 3B is a bottom perspective view of the second corner sealing member;

FIG. 4A is a perspective view of a right portion of the integrated water defense system including a threshold and a jamb extending upwardly from the threshold;

FIG. 4B is a side view of a right side of the threshold;

DETAILED DESCRIPTION OF THE INVENTION

Figure 1:
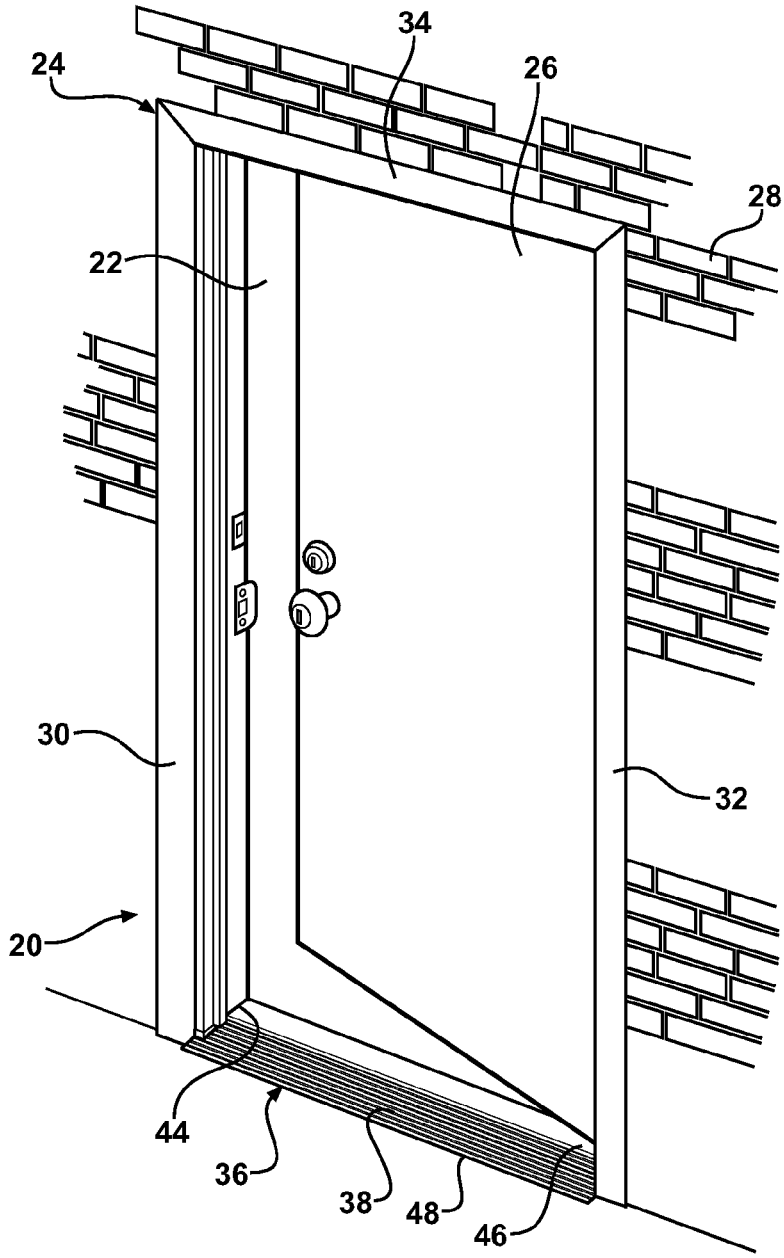
FIG. 1 is a perspective view of an entryway of a building.

Referring to the Figures, wherein like numerals indicate like parts throughout the several views, an entryway 20 for a door opening 22 is generally shown. As shown in FIG. 1, the entryway 20 includes a frame 24 and a door 26 rotatably mounted to the frame 24. The frame 24 is mounted in the door opening 22 of a building 28 such as a commercial or a residential building 28. The frame 24 includes a pair of jambs spaced from each other, i.e., a first jamb 30 and a second jamb 32 spaced from and in parallel with the first jamb 30. The frame 24 typically includes a header 34 disposed above and extending between the first jamb 30 and the second jamb 32. An integrated water defense system 36 is mounted in the door opening 22 of the building 28 below the frame 24 and the door 26. The integrated water defense system 36 extends across the door opening 22 below the first and second jambs 30, 32 of the frame 24.

Figure 2A:
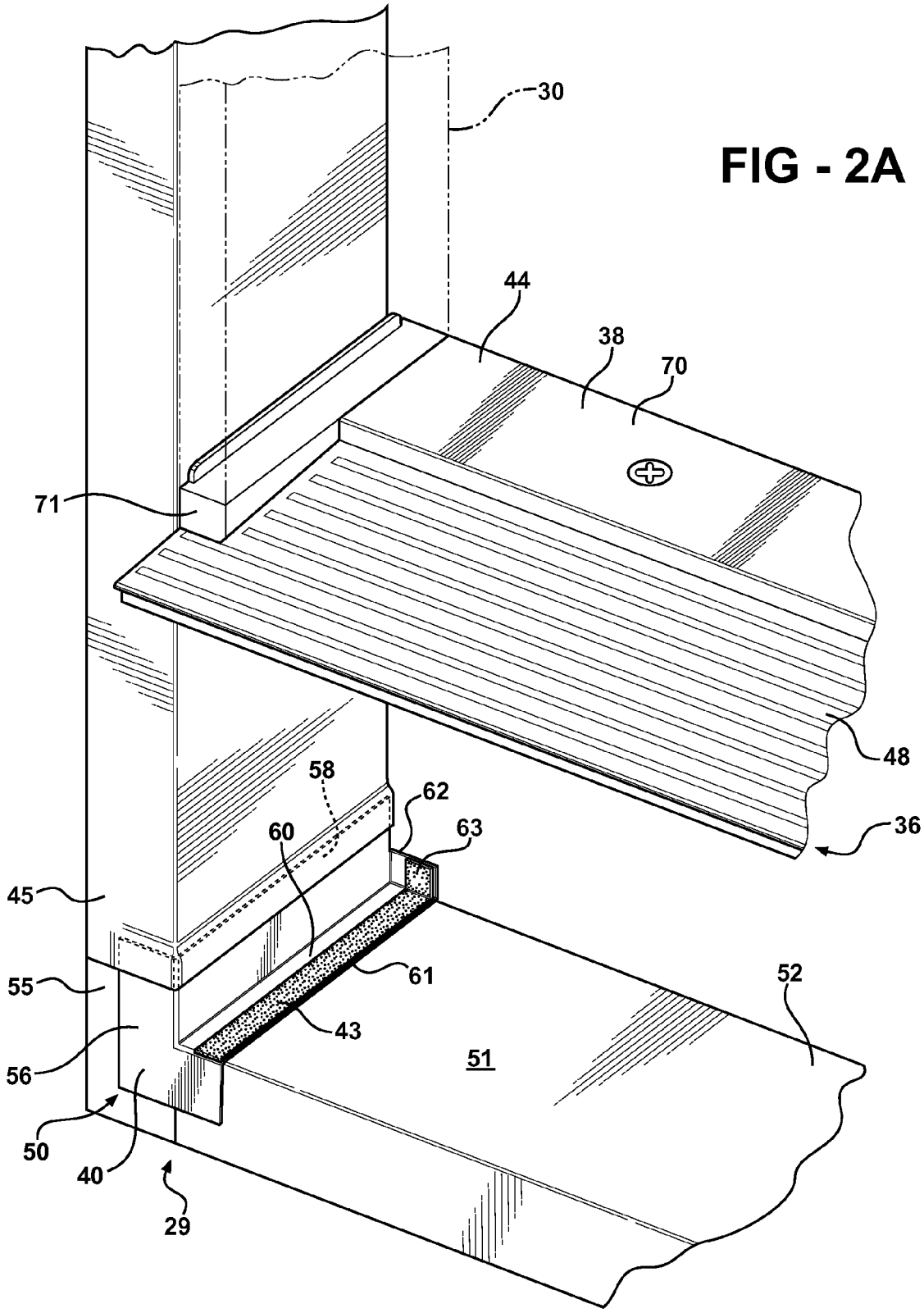
FIG. 2A is a partially exploded view of a left portion of the entryway including an integrated water defense system having a first corner sealing member.
Figure 2B:
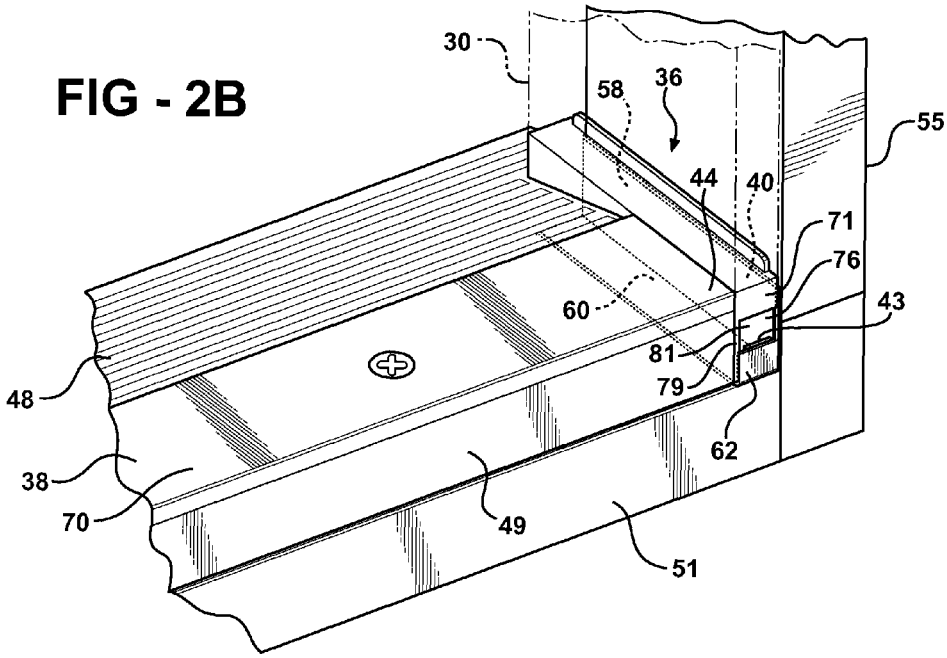
FIG. 2B is another perspective view of the left portion of the entryway shown in FIG. 2A.

As best shown in FIGS. 2A-B, the building 28 typically includes framing 29 defining the door opening 22 of the building 28, also referred to in industry as the rough opening. The framing 29 typically includes a floor 51, a first frame member 55 extending upwardly from the floor 51, and a second frame member 57 extending upwardly from the floor 51 spaced from the first frame member 55. The first and second frame members 55, 57 are commonly referred to as cripples. The framing 29 typically defines the door opening 22 of the building 28 as rectangular in shape.

As best shown in FIGS. 2A-3B, the integrated water defense system 36 includes a threshold 38 and a pair of corner sealing members, i.e., first and second corner sealing members 40, 42, adjacent the threshold 38. Specifically, the threshold 38 extends longitudinally between a first end 44 for disposition adjacent the first frame member 55 and a second end 46 for disposition adjacent the second frame member 57. The threshold 38 includes a bottom 47 facing downwardly from the first end 44 to the second end 46 of the threshold 38. A back 49 extends upwardly from the bottom 47 between the first end 44 and the second end 46. The first corner sealing member 40 is shown in FIGS. 2A, 2B, 5, and 6. The second corner sealing member 42 is shown in isolation in FIGS. 3A-3B. It should be appreciated that the first and second corner sealing members 40, 42 are typically mirror images each other.

Figure 2C:
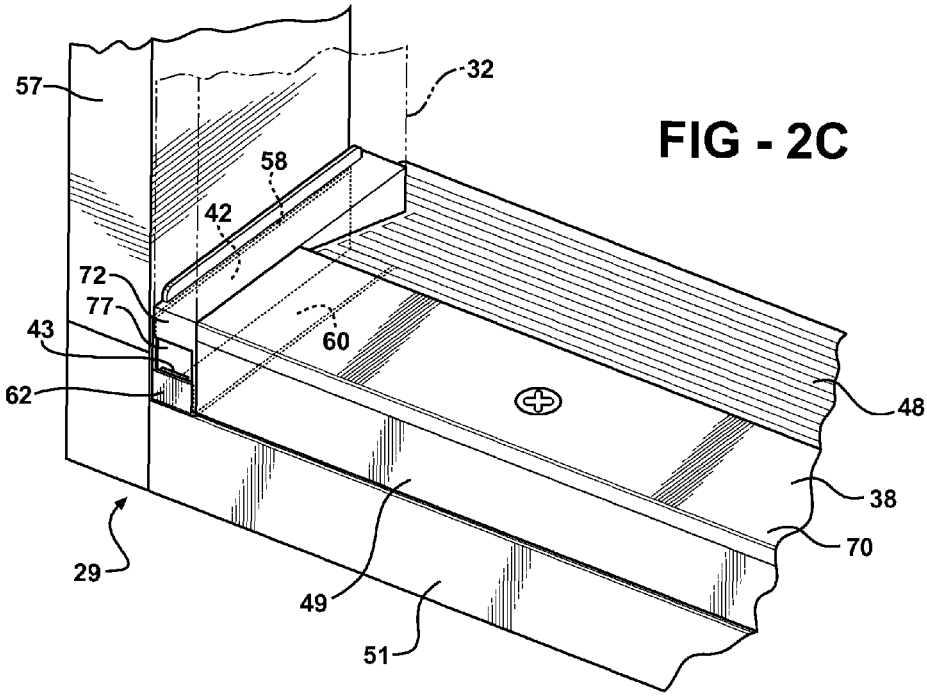
FIG. 2C is a perspective view of a right portion of the entryway and a second corner sealing member.

The first corner sealing member 40 is adjacent the first end 44 of the threshold 38 and the second corner sealing member 42 is adjacent the second end 46 of the threshold 38. The first and second corner sealing members 40, 42 are disposed between a portion of the framing 29 and the threshold 38. Specifically, the framing 29 typically defines two lower corners, i.e., the first frame member 55 and the floor 51 define one of the lower corners and the second frame member 57 and the floor 51 define the other of the lower corners. One of the lower corners is shown in FIGS. 2A-2B and the other of the lower corners is shown in FIG. 2C. The first corner sealing member 40 is disposed between one of the lower corners and the first end 44 of the threshold 38 and the second corner sealing member 42 is disposed between the other of the lower corners and the second end 46 of the threshold 38.

The first and second jambs 30, 32, the header 34, and the integrated water defense system 36 are mounted to the framing 29 about the door opening 22 of the building 28 in the configuration shown in FIG. 1. The first jamb 30 is disposed adjacent the first frame member 55 and the second jamb 32 is disposed adjacent the second frame member 57.

The first and second corner sealing members 40, 42 can be disposed in the respective lower corners of the framing 29 without being fixed to or sealed to the framing 29. In the alternative, the first and second corner sealing members 40, 42 can be secured to the lower corners of the framing 29. For example, the first and second corner sealing members 40, 42 can be secured to the framing 29 with fasteners such as nails or screws. Alternatively, or in addition, the first and second corner sealing members 40, 42 can include self sealing foam tape, e.g., double-sided foam tape, for adhering to the framing 29. However, it should be appreciated that the first and second corner sealing members 40, 42 may be secured to the framing 29 in any fashion without departing from the nature of the present invention.

The first and second corner sealing members 40, 42 are typically formed of a water impervious material. For example, the first and second corner sealing members 40, 42 are formed of plastic, such as acrylonitrile butadiene styrene, which is commonly referred to in industry as ABS. In one embodiment, the first and second corner sealing members 40, 42 are formed by extrusion. However, it should be appreciated that the first and second corner sealing members 40, 42 may be formed from any suitable water impervious material and may be formed by any process without departing from the nature of the present invention.

The integrated water defense system 36 protects the framing 29 of the building 28 in the case of water intrusion between the first jamb 30 and the first frame member 55 and/or between the second jamb 32 and the second frame member 57. The first and second corner sealing members 40, 42 divert water from between the first jamb 30 and first frame member 55 and/or between the second jamb 32 and the second frame member 57 to the exterior of the building 28. In other words, in the event of water intrusion between the first jamb 30 and the first frame member 55 and/or between the second jamb 32 and the second frame member 57, the water will flow downwardly to the respective first and second corner sealing members 40, 42, where the water will be retained, i.e., pooled, or diverted by the respective first and second corner sealing members 40, 42 to the exterior of the building 28. The first and second corner sealing members 40, 42 are typically covered by the threshold 38 and therefore do not aesthetically distract from the integrated water defense system 36.

As shown in FIG. 2A-2B, the floor 51, the first frame member 55, and the second frame member 57 define an exterior surface 50. The floor 51 presents a horizontal surface 52. Each of the first and second frame members 55, 57 define a vertical surface 54. The first corner sealing member 40 contacts each exterior surface 50, horizontal surface 52, and the vertical surface 54 defined by the first frame member 55. The second corner sealing member 42 contacts each of the exterior surface 50, horizontal surface 52, and the vertical surface 54 defined by the second frame member 57.

Each corner sealing member 40, 42 includes a middle portion 60, a first vertical portion 58 extending upwardly from the middle portion 60, and a second vertical portion 62 extending upwardly from the middle portion 60 transversely from the first vertical portion 58. The corner sealing members 40, 42 can also include an exterior flange 56 extending downwardly from the middle portion 60 and outwardly from the first vertical portion 58.

The middle portion 60, first vertical portion 58, second vertical portion 62, and exterior flange 56 are typically integral with each other. In other words, the first and second corner sealing members 40, 42 are each a single continuous unit. Preferably the first and second corner sealing members 40, 42 are each formed as a single continuous unit. However, it should be appreciated that the middle portion 60, first vertical portion 58, second vertical portion 62, and exterior flange 56 may be formed separately and subsequently integrated together without departing from the nature of the present invention.

The exterior flange 56 is planar and abuts the exterior surface 50 of the framing 29. The exterior flange 56 is L-shaped with an upper flange portion 64 extending vertically along the exterior surface 50 of the framing 29 and a lower flange portion 66 extending horizontally along the exterior surface 50 of the framing 29. Although the exterior flange 56 is shown extending generally vertically, it should be appreciated that the exterior flange 56 may extend at any angle, for example, to accommodate a shape of the framing 29.

The middle portion 60 of the corner sealing member 40, 42 is disposed partially below the bottom 47 of the threshold 38 for sealing to the floor 51. Further, the middle portion 60 is disposed below the jamb 30, 32 for guiding water that travels downwardly between the respective jamb 30, 32 and the respective frame member 55, 57. The middle portion 60 is planar and extends either horizontally or at a slight angle relative to horizontal from the lower flange portion 66 of the exterior flange 56. The slight angle relative to horizontal diverts water from middle portion 60 to an exterior of the building 28. The middle portion 60 abuts the horizontal surface 52 of the floor 29. Although the first vertical portion 58 and the middle portion 60 are shown extending generally vertically and slightly angled relative horizontal, respectively, it should be appreciated that the first vertical portion 58 and the middle portions 58, 60 may extend at any angle relative to each other, for example, to accommodate the shape of the framing 29.

The first vertical portion 58 of the corner sealing member 40, 42 abuts the first end 44 of the threshold 38 for sealing to the respective frame member 55, 57. The first vertical portion 58 of the corner sealing member 40, 42 is disposed outwardly from the respective end 44, 46 of the threshold 38 for guiding water that travels downwardly between the respective jamb 30, 32 and the respective frame member 55, 57. The first vertical portion 58 is planar and extends generally vertically from the upper flange portion 64 of the exterior flange 56.

Figure 7:
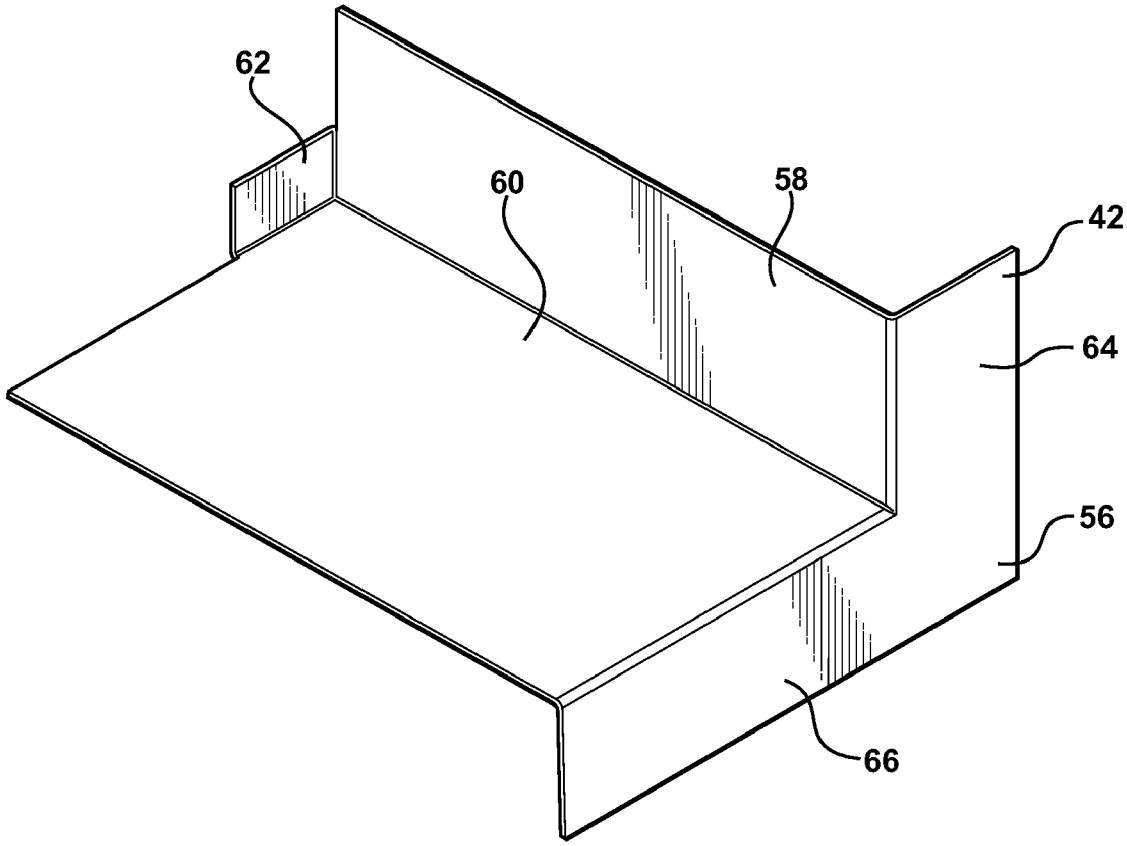
FIG. 7 is a front perspective view of another embodiment of the second corner sealing member.

The second vertical portion 62 is planar. It should be appreciated that the second vertical portion 62 may extend at any angle relative to the first vertical portion 58 and the middle portion 60 without departing from the nature of the present invention. The middle portion 58 can extend further from the first vertical portion 60 than does the second vertical portion 62, as shown in FIG. 7.

The threshold 38 typically includes a base 68, a sill 48 disposed on the base 68, and first and second end caps 71, 72 disposed on at least one of the base 68 and sill 48 at the first and second ends 44, 46, respectively, of the threshold 38. The base 68 and/or the first and second end caps 71, 72 are typically in contact with and supported by the floor 29. The first jamb 30 extends upwardly relative to the threshold 38 at the first end 44 of the threshold 38 and is supported by the threshold 38. Likewise, the second jamb 32 extends upwardly relative to the threshold 38 at the second end 46 of the threshold 38 and is supported by the threshold 38. Typically the first jamb 30 is engaged with the first end cap 71 and the second jamb 32 is engaged with the second end cap 72. The back 49 of the threshold 38 is typically defined by and extends across the base 68 and the end caps 71, 72.

The base 68 supports the sill 48. The base 68 is typically formed of a rigid material such as plastic or metal and is typically formed by extrusion. However, it should be appreciated that the base 68 may be formed of any suitable rigid material and may be formed by any process without departing from the nature of the present invention. For example, the base 68 typically includes an interior trim piece (not shown).

The sill 48 rests on the base 68. The sill 48 is preferably formed of a rigid material such as metal, and more specifically aluminum. The sill 48 is typically formed by extrusion. However, it should be appreciated that the sill 48 may be formed of any suitable rigid material and may be formed by any process without departing from the nature of the present invention.

The threshold 38 can include an adjustable rail 70 that is vertically adjustable relative to the sill 48 and the base 68. The adjustable rail 70 is preferably formed of a rigid material such as metal, plastic, or wood. In such a configuration, the threshold 38 includes a sealing member engaging the sill 48. It should be appreciated that the threshold 38 may be fixed relative to the sill 48 without departing from the nature of the present invention.

The threshold 38 is configured to accommodate the respective first and second corner sealing members 40, 42, i.e., the threshold 38 and the first and second corner sealing members 40, 42 are configured to advantageously interact with each other. Specifically, the threshold 38 and the first and second corner sealing members 40, 42 are configured to seal with each other to prevent water from migrating from the corner sealing member 40, 42 to the floor 51 or the first and second frame members 55, 57. In addition, the threshold 38 and the first and second corner sealing members 40, 42 are configured such that the corner sealing members 40, 42 do not interfere with the fit of the threshold 38 with the framing 29, i.e., such that the threshold 38 is positioned flush with the horizontal surface 52 of the framing 29.

The threshold 38 defines a pair of recesses, i.e., a first recess 76 and a second recess 77, and the second vertical portion 62 of the corner sealing member 40, 42 is disposed in the respective recess 76, 77. As best shown in FIG. 2B-2C, the second vertical portion 62 of the corner sealing member 40, 42 is disposed entirely within the respective recess 76, 77.

Each of the recesses 76, 77 extend upwardly from the bottom 47 of the threshold 38. The first recess 76 extends from the first end 44 of the threshold 38 toward the second end 46 of the threshold 38. The second recess 77 extends from the second end 46 of the threshold 38 toward the first end 44 of the threshold 38. In the embodiment shown in the Figures, the end caps 71, 72 define the recesses 76, 77. However, it should be appreciated that any part of the threshold 38 can define the recesses 76, 77 without departing from the nature of the present invention.

The back 49 of the threshold 38 includes a first outboard surface 79 and a second outboard surface 80. The back 49 also includes a first recessed surface 81 recessed from the first outboard surface 79 to define the first recess 76 and a second recessed surface 82 recessed from the second outboard surface 80 to define the second recess 77.

The second vertical portion 62 of the first corner sealing member 40 engages the first recessed surface 81 and the second vertical portion 62 of the second corner sealing member 42 engages the second recessed surface 82. In other words, the second vertical portion 62 can abut, seal to, and/or connect to the recessed surface 80, 82 in some manner.

The corner sealing member 40, 42 is typically sealed to the threshold 38. For example, at least a portion of the middle portion 60 of the corner sealing member 40, 42 can be sealed to the bottom 47 of the threshold 38, i.e., the middle portion 60 can include a horizontal distal portion 61 spaced from the first vertical portion 58 and the horizontal distal portion 61 is sealed to the bottom 47 of the threshold 38.

In addition, or in the alternative, at least a portion of the second vertical portion 62 of the corner sealing member 40, 42 can be sealed to the back 49 of the threshold 38. Specifically, the second vertical portion 62 of the corner sealing member 40, 42 can include a vertical distal portion 63 spaced from the first vertical portion 58 with the vertical distal portion 62 sealed to the back 49 of the threshold 38.

For example, as shown in FIGS. 2A, 2B, 5, and 6, the integrated water defense system 36 can include a sealing medium 43 to seal the threshold 38 to the first and second corner sealing members 40, 42. For example, the sealing medium 43 can be sealed to at least one of the middle portion 60 and the second vertical portion 62 and can be sealed to at least one of the bottom 47 and the back 49 of the threshold 38.

Figure 5:
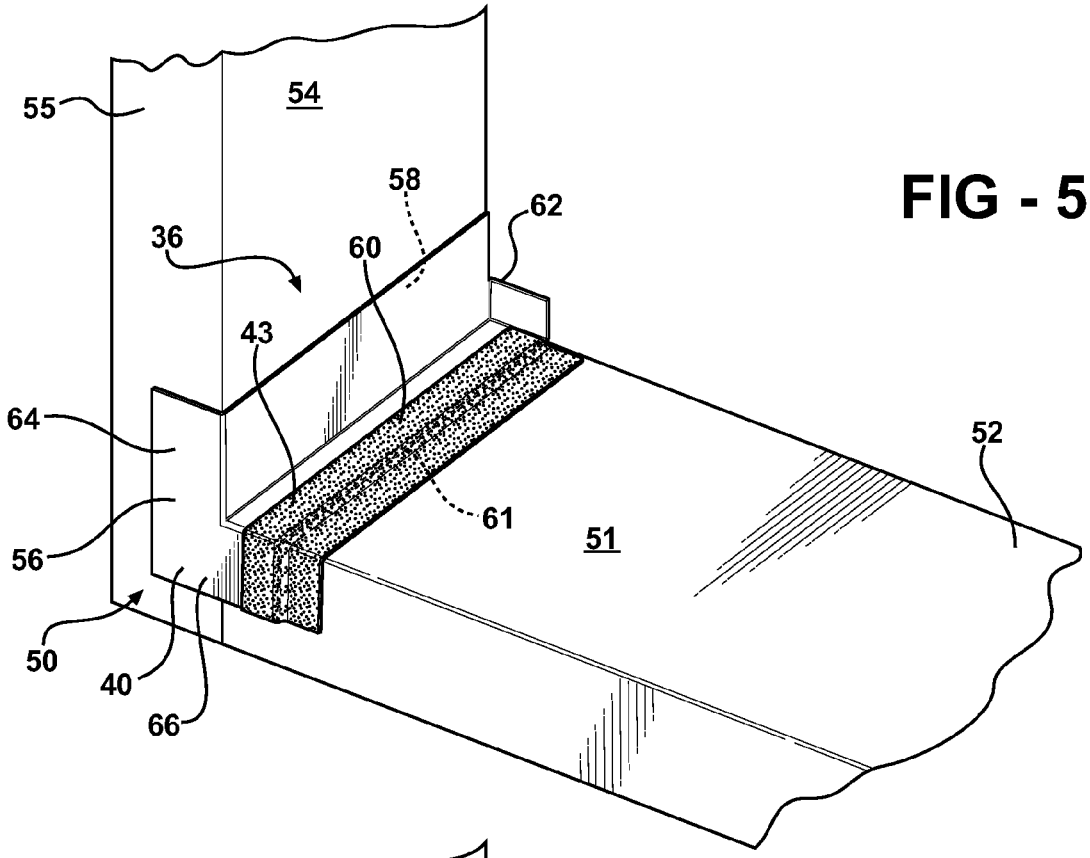
FIG. 5 is a perspective view of the left portion of the entryway including an alternative embodiment of the integrated water defense system.
Figure 6:
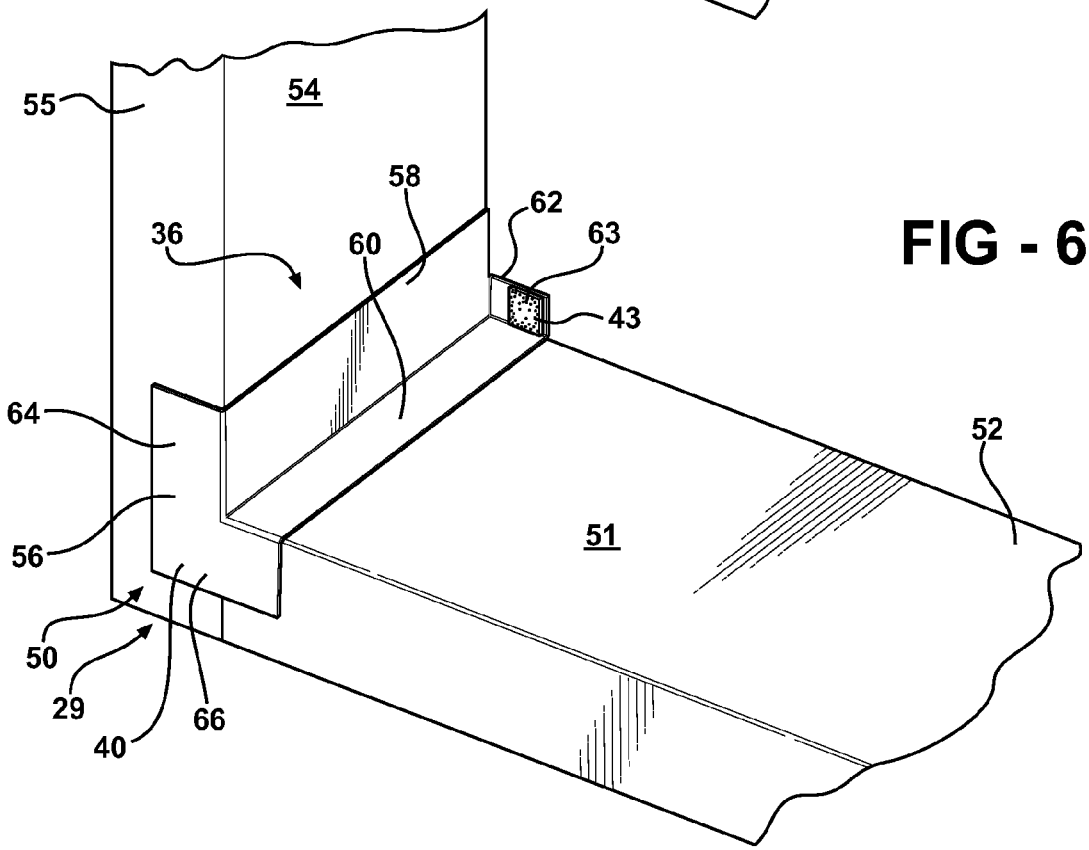
FIG. 6 is a perspective view of the left side of the entryway including another alternative embodiment of the integrated water defense system.

As shown in FIG. 2A, the sealing medium 43 can be positioned to seal the middle portion 60 of the corner sealing member 40, 42 to the bottom 47 of the threshold 38 and can be positioned to seal the second vertical portion 62 of the corner sealing members 40, 42 to the back 49 of the threshold 38. Alternatively, as shown in FIG. 5, the sealing medium 43 can be positioned to seal only the middle portion 60 of the corner sealing member 40, 42 to the bottom 47 of the threshold 38. As another alternative, as shown in FIG. 6, the sealing medium 43 can be positioned to seal only the second vertical portion 62 of the corner sealing members 40, 42 to the back 49 of the threshold 38. It should be appreciated that the sealing medium 43 can be sealed to the corner sealing members 40, 42 in any position relative to the corner sealing members 40, 42.

The sealing medium 43 can be applied as a solid material or a flowable material and can be, for example, a gasket, double-sided foam tape, adhesive, foam, rubber, caulk, glazing tape, housewrap, etc. The sealing medium 43 is typically formed from a water impervious material. However, it should be appreciated that the sealing medium 43 can be any material that adequately seals the corner sealing member 40, 42 to the threshold 38. In any case, the sealing medium 43 forms a water-tight seal between the corner sealing member 40, 42 and the threshold 38.

In addition to sealing the threshold 38 to the first and second corner sealing members 40, 42, the sealing medium 43 can seal the first and second corner sealing members 40, 42 to the framing. For example, as shown in FIG. 5, the sealing medium 43 overlaps the middle portion 60 of the first corner sealing member 40 and the floor 51 to prevent water from leaking along the floor 51 below the first corner sealing member 40. The sealing medium 43 can overlap the lower flange portion 66 of the exterior flange 56 and the floor 51 to seal the lower flange portion 66 to the floor 51.

Figure 4C:
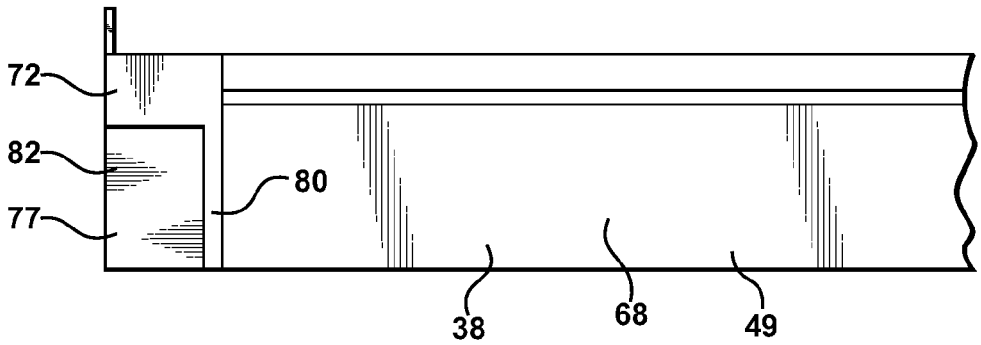
FIG. 4C is a rear view of the right side of the threshold.

As shown in FIG. 4A, the bottom 47 of the threshold 38 can include a sealing portion 78 that is planar for sealing to the middle portion 60 of the corner sealing member 40, 42. It should be appreciated that only the second end 46 of the threshold 38 is shown in FIG. 4A and that the first end 44 of the threshold 38 can be a mirror image of the second end 46 such that the first end 44 also includes the sealing portion 78.

Because the bottom 47 of the threshold 38 is planar, the bottom 47 advantageously seals to the middle portion 60 of the corner sealing member 40, 42, e.g., along the gasket 43. However, it should be appreciated that an adequate seal can also be accomplished by the contact between the middle portion 60 of the corner sealing members 40, 42 and the bottom 47 of the threshold 38 due to the planar configuration of the bottom 47. It should also be appreciated that the entire bottom 47 of the threshold 38 can be planar from the first end 44 to the second end 46 of the threshold 38.

It should be appreciated that the threshold 38 can be configured to accommodate first vertical portion 58 and the middle portion 60 of the respective first and second end caps 71, 72. For example, the threshold can define additional cutouts for receiving the first vertical portion 58 and the middle portion 60 of the respect first and second end caps 71, 72.

The integrated water defense system 36 can include a second sealing medium 45 to seal the corner sealing member 40, 42 to the respective frame member 55, 57 to prevent water from flowing downwardly along the frame member 40, 42 between the corner sealing member 40, 42 and the respective frame member 55, 57. Specifically, the second sealing medium 45 seals the first vertical portion 58 of the corner sealing member 40, 42 to the respective frame member 55, 57. For example, as shown in FIGS. 2A-2B, the second sealing medium 45 seals the first corner sealing member 40 to the first frame member 55 to prevent water from leaking along the first frame member 55 between the first corner sealing member 40 and the first frame member 55. Likewise, as shown in FIG. 2C, the second sealing medium 45 seals the second corner sealing member 42 to the second frame member 57 to prevent water from leaking along the second frame member 57 between the second corner sealing member 42 and the second frame member 57.

The second sealing medium 45 is typically housewrap that overlaps the first vertical portion 58 of the corner sealing member 40, 42 and the respective frame member 55, 57. Alternatively, for example, the second sealing medium 45 can be applied as a solid material or a flowable material and can be, for example, a gasket, double-sided foam tape, adhesive, foam, rubber, caulk, glazing tape, etc. The second sealing medium 45 is typically formed from a water impervious material. However, it should be appreciated that the second sealing medium 45 can be any material that adequately seals the corner sealing member 40, 42 to the respective frame member 55, 57.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. An entryway for disposition in a door opening of a building defined by a floor and first and second frame members extending upwardly from the floor, said entryway comprising:

a threshold having a first end for disposition adjacent the first frame member and a second end spaced from said first end for disposition adjacent the second frame member, a bottom facing downwardly from said first end to said second end, and a back extending upwardly from said bottom between said first end and said second end;

a jamb extending upwardly relative to said threshold at said first end of said threshold and supported by said threshold for disposition adjacent the first frame member; and a corner sealing member having a middle portion disposed partially below said bottom of said threshold for sealing to the floor, a first vertical portion extending upwardly from said middle portion adjacent said first end of said threshold for sealing to the first frame member, and a second vertical portion extending upwardly from said middle portion transversely from said first vertical portion;

wherein said back of said threshold defines a recess and said second vertical portion of said corner sealing member is disposed in said recess.

2. The entryway as set forth in claim 1 wherein said recess extends from said first end of said threshold toward said second end of said threshold.

3. The entryway as set forth in claim 2 wherein said recess extends upwardly from said bottom of said threshold.

4. The entryway as set forth in claim 3 wherein said back of said threshold includes an outboard surface and a recessed surface recessed from said outboard surface to define said recess and wherein said second vertical portion engages said recessed surface.

5. The entryway as set forth in claim 1 wherein at least a portion of said middle portion of said corner sealing member is sealed to said bottom of said threshold.

6. The entryway as set forth in claim 5 wherein said middle portion of said corner sealing member includes a horizontal distal portion spaced from said first vertical portion and wherein said horizontal distal portion is sealed to said bottom of said threshold.

7. The entryway as set forth in claim 5 wherein said second vertical portion of said corner sealing member includes a vertical distal portion spaced from said first vertical portion and wherein said vertical distal portion is sealed to said back of said threshold.

8. The entryway as set forth in claim 5 wherein said bottom of said threshold includes a sealing portion that is planar for sealing to said middle portion of said corner sealing member.

9. The entryway as set forth in claim 1 further comprising a sealing medium sealed to at least one of said middle portion and said second vertical portion of said corner sealing member and sealed to at least one of said bottom of said threshold and said back of said threshold.

10. The entryway as set forth in claim 1 further comprising a sealing medium sealed to said first vertical portion of said corner sealing member for sealing to the first frame member.

11. The entryway as set forth in claim 1 wherein said middle portion of said corner sealing member is disposed below said jamb for guiding water that travels downwardly between said first jamb and the first frame member away from the building.

12. The entryway as set forth in claim 11 wherein said first vertical portion is disposed outwardly from said first end of said threshold for guiding the water that travels downwardly between the first jamb and the first frame member toward said middle portion.

13. The entryway as set forth in claim 1 wherein said second vertical portion of said corner sealing member is disposed entirely within said recess.

14. The entryway as set forth in claim 1 wherein said corner sealing member includes an exterior flange spaced from said second vertical portion and extending outwardly from said first vertical portion for abutting the first frame member of the building and extending downwardly from said middle portion for abutting the floor of the building.

15. The entryway as set forth in claim 1 further comprising a second corner sealing member spaced from said first corner sealing member and having a middle portion disposed partially below said threshold and abutting said bottom of said threshold for sealing to the floor, a first vertical portion extending upwardly from said middle portion and abutting said second end of said threshold for sealing to the second frame member, and a second vertical portion extending upwardly from said middle portion transversely from said first vertical portion.

16. The entryway as set forth in claim 15 further comprising a second jamb extending upwardly relative to said threshold and supported by said threshold for disposition adjacent the second frame member.

17. The entryway as set forth in claim 16 wherein said middle portion of said second corner sealing member is disposed below said second jamb for guiding water that travels downwardly between said second jamb and the second frame member away from the building.

18. The entryway as set forth in claim 17 wherein said first vertical portion of said second corner sealing member is disposed outwardly from said second end of said threshold for guiding the water that travels downwardly between the second jamb and the second frame member toward said middle portion.

19. The entryway as set forth in claim 1 wherein said jamb is engaged with and extends upwardly from said threshold.

20. The entryway as set forth in claim 1 wherein said threshold includes a first end cap at said first end of said threshold for being supported by the floor of the building and a sill extending from said first end cap toward said second end of said threshold.

21. The entryway as set forth in claim 20 wherein said first end cap defines said recess.

22. The entryway as set forth in claim 20 wherein said first end cap supports said jamb.

23. The entryway as set forth in claim 1 wherein said corner sealing member is formed from a water impervious material.

24. The entryway as set forth in claim 1 wherein said corner sealing member is formed of plastic.

25. An entryway for disposition in a door opening of a building defined by a floor and first and second frame members extending upwardly from the floor, said entryway comprising:

a threshold having a first end for disposition adjacent the first frame member and a second end spaced from said first end for disposition adjacent the second frame member, a bottom facing downwardly from said first end to said second end, and a back extending upwardly from said bottom between said first end and said second end;

a first jamb and a second jamb spaced from said first jamb with each of said jambs extending upwardly relative to said threshold with said first jamb supported by said threshold at said first end of said threshold for disposition adjacent the first frame member and with said second jamb supported by said threshold at said second end of said threshold for disposition adjacent the second frame member; and a first corner sealing member and a second corner sealing member spaced from each other, each of said corner sealing members comprising:

a middle portion disposed partially below said bottom of said threshold for sealing to the floor wherein said middle portion of said first corner sealing member is disposed below said first jamb for guiding water that travels downwardly between said first jamb and said first frame member and wherein said middle portion of said second corner sealing member is disposed below said second jamb for guiding water that travels downwardly between said second jamb and said second frame member;

a first vertical portion extending upwardly from said middle portion wherein said first vertical portion of said first sealing member is adjacent said first end of said threshold for sealing to the first frame member and wherein said vertical portion of said second sealing member is adjacent said second end of said threshold for sealing to the second frame member; and a second vertical portion extending upwardly from said middle portion transversely from said first vertical portion;

wherein said back of said threshold defines a first recess and a second recess each extending upwardly from said bottom of said threshold wherein said first recess extends from said first end of said threshold toward said second end of said threshold and wherein said second recess extends from said second end of said threshold toward said first end of said threshold;

wherein said second vertical portion of said first corner sealing member is disposed in said first recess and said second vertical portion of said second corner sealing member is disposed in said second recess; and wherein at least a portion of said middle portion of each of said corner sealing member is sealed to said bottom of said threshold.

* * * * *